US009022794B2

(12) United States Patent
Wang

(10) Patent No.: US 9,022,794 B2
(45) Date of Patent: May 5, 2015

(54) WATERPROOF SHIELD CONNECTOR HAVING A SHIELD SHELL INTEGRAL WITH AN ELECTRIC WIRE

(71) Applicant: Yazaki Corporation, Tokyo (JP)

(72) Inventor: Feng Wang, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 69 days.

(21) Appl. No.: 13/850,585

(22) Filed: Mar. 26, 2013

(65) Prior Publication Data

US 2013/0260585 A1 Oct. 3, 2013

(30) Foreign Application Priority Data

Mar. 27, 2012 (JP) ..... 2012-071560

(51) Int. Cl.

| | |
|---|---|
| ***H01R 13/52*** | (2006.01) |
| ***H01R 13/6596*** | (2011.01) |
| *H01R 13/6592* | (2011.01) |
| *H01R 13/74* | (2006.01) |
| *H01R 103/00* | (2006.01) |

(52) U.S. Cl.

CPC ..... *H01R 13/5202* (2013.01); *H01R 13/5205* (2013.01); *H01R 13/6596* (2013.01); *H01R 13/6592* (2013.01); *H01R 13/74* (2013.01); *H01R 2103/00* (2013.01)

(58) Field of Classification Search

None

See application file for complete search history.

(56) References Cited

U.S. PATENT DOCUMENTS

| | | | | |
|---|---|---|---|---|
| 7,753,734 | B2 * | 7/2010 | Eckel et al. | 439/607.41 |
| 2004/0229508 | A1 | 11/2004 | Miyazaki et al. | |
| 2005/0142942 | A1 | 6/2005 | Hayashi | |
| 2009/0017685 | A1 * | 1/2009 | Eckel et al. | 439/610 |
| 2009/0029594 | A1 | 1/2009 | Matsuoka | |
| 2009/0130901 | A1 | 5/2009 | Aoki et al. | |
| 2014/0209377 | A1 * | 7/2014 | Wang | 174/658 |
| 2014/0235104 | A1 * | 8/2014 | Wang | 439/607.41 |

FOREIGN PATENT DOCUMENTS

| | | | |
|---|---|---|---|
| CN | 1551455 | A | 12/2004 |
| CN | 101355209 | A | 1/2009 |
| JP | 2005-129355 | A | 5/2005 |
| JP | 2009-123584 | A | 6/2009 |

OTHER PUBLICATIONS

Office Action dated Jan. 6, 2015, issued by the State Intellectual Property Office of P.R. China in counterpart Chinese Application No. 201310118864.9.

* cited by examiner

*Primary Examiner* — Chandrika Prasad

(74) *Attorney, Agent, or Firm* — Sughrue Mion, PLLC

(57) ABSTRACT

A waterproof shield connector includes an electric wire to which a terminal fitting is connected at an end portion of the electric wire, a resin housing, a rubber waterproof ring, and a shield shell. The resin housing has a terminal insertion hole that holds the electric wire and a rear opening through which the electric wire is inserted. The shield shell is integrally formed with a ring pressing part that closes the rear end opening to cover a rear end of a waterproof ring disposed in the terminal insertion hole and prevent the waterproof ring from a detachment. The shield shell is integrally formed with an electric wire pressing part that is fitted to an outer periphery of the electric wire inserted into the terminal insertion hole and restricts displacement of the electric wire in a radial direction of the electric wire.

2 Claims, 4 Drawing Sheets

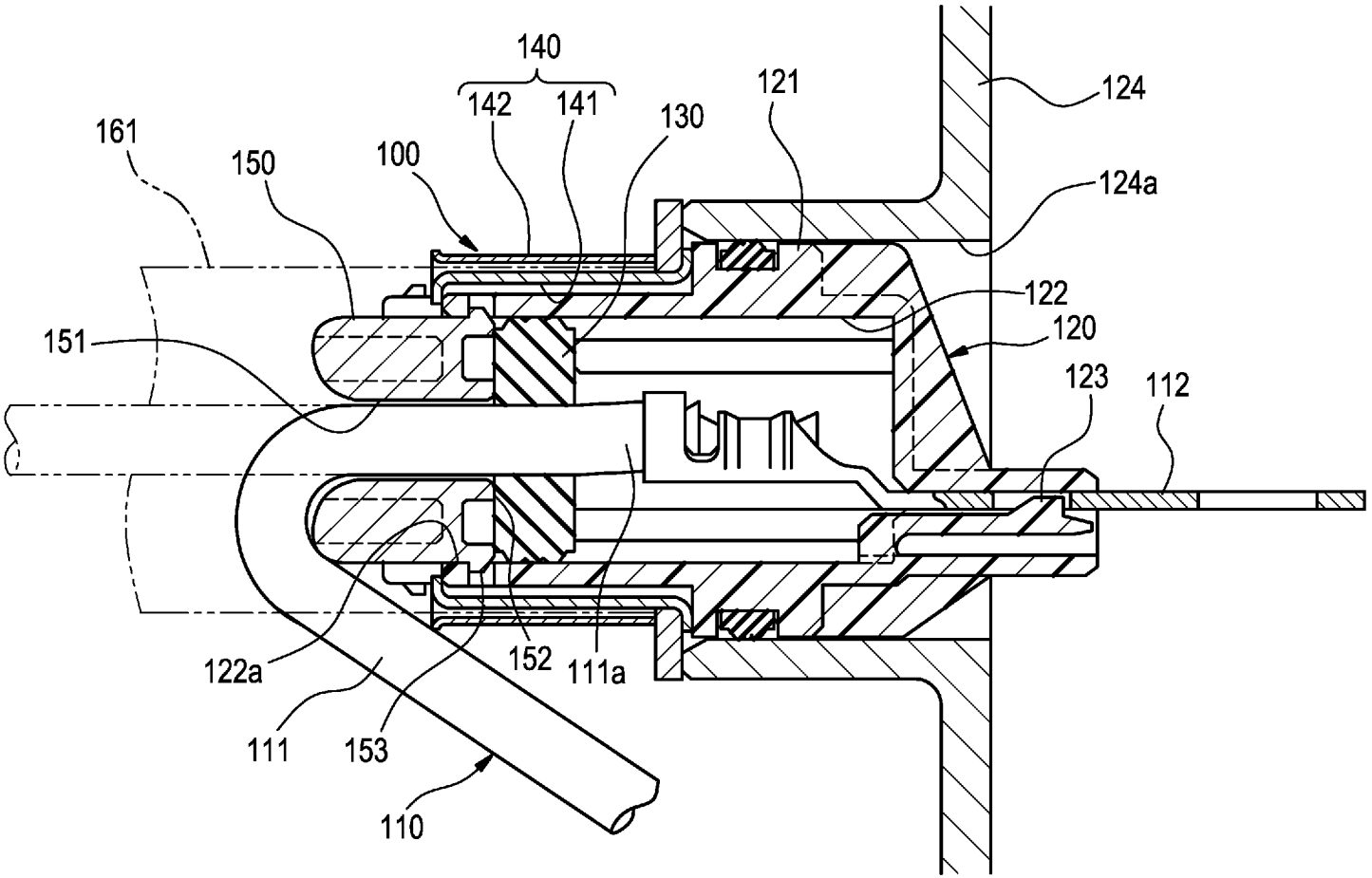
FIG.4 -- Related Art --

WATERPROOF SHIELD CONNECTOR HAVING A SHIELD SHELL INTEGRAL WITH AN ELECTRIC WIRE

CROSS REFERENCE TO RELATED APPLICATION

This application is based on Japanese Patent Applications No. 2012-071560 filed on Mar. 27, 2012, the contents of which are incorporated herein by reference.

BACKGROUND OF THE INVENTION

1. Technical Field

The present invention relates to a waterproof shield connector.

2. Background Art

FIG. 4 shows a waterproof shield connector in a related art.

A waterproof shield connector 100 is disclosed in JP-A-2005-129355. This waterproof shield connector 100 includes an electric wire 110 with a terminal, a resin housing 120, a rubber waterproof ring 130 and a shield shell 140.

In the electric wire 110 with the terminal, an end (electric wire end) 111*a* of a covered electric wire 111 is connected to a terminal fitting 112 which is conductively connected to a connection terminal of an equipment.

As shown in FIG. 4, the resin housing 120 includes a case fitting part 121 which is fitted and connected to a connector fitting hole 124*a* of a shield case 124 of the equipment and a terminal insertion hole 122 which is formed through the case fitting part 121.

The shield case 124 is a metallic housing for connecting a connector, which is equipped to an inverter device or the like of an electric vehicle, for example.

The terminal insertion hole 122 of the resin housing 120 is a hole part which receives and holds the electric wire end 111*a* of the electric wire 110 with the terminal and the terminal fitting 112 through a rear end opening 122*a*. The terminal fitting 112 received in the terminal insertion hole 122 is locked to a lance 123 equipped to face the terminal insertion hole 122 and therefore is prevented from being detached. A leading end of the terminal fitting 112 locked to the lance 123 protrudes from a leading end of the case fitting part 121 and is connected to a connection terminal (not shown) in the shield case 124.

The waterproof ring 130 is fitted and mounted to the terminal insertion hole 122. The waterproof ring 130 is arranged in the terminal insertion hole 122 in such a way that an inner periphery of the waterproof ring is in close contact with an outer peripheral surface of the electric wire 111 in the terminal insertion hole 122 and an outer periphery thereof is in close contact with an inner peripheral surface of the terminal insertion hole 122. In this way, sealing between the electric wire 111 and the terminal insertion hole 122 is achieved so that a waterproof property is secured in the terminal insertion hole 122.

A cylindrical rear holder 150 is fitted and mounted to the rear end opening 122*a* of the terminal insertion hole 122. The rear holder 150 includes an electric wire holding hole 151 to hold an outer periphery of the electric wire 111, a ring pressing part 152 abutting against the waterproof ring 130 to prevent detachment of the waterproof ring 130 and a locking protrusion 153 which is engaged with a lock hole 122*b* formed on the terminal insertion hole 122 to couple the rear holder to the resin housing 120. The electric wire holding hole 151 of the rear holder 150 restricts the movement of the electric wire 111 in a radial direction. By doing so, it is prevented that the waterproof ring 130 is distorted in the radial direction by a bending load applied to the electric wire 111 and thus the waterproof property is degraded.

The shield shell 140 is made of metal and is fitted and mounted to an outer side of the resin housing 120 so as to cover an outer periphery of the resin housing 120, so that an interior of the resin housing 120 is electromagnetically shielded from the surroundings. The shield shell 140 has a dual-cylinder structure which includes a cylindrical inner shell 141 fitted to an outer periphery of the resin housing 120 and an outer shell 142 fitted to an outer periphery of the inner shell 141. The electric wire 111 is covered with a metal braided wire 161 for electromagnetic shielding. The inner shell 141 and the outer shell 142 are conductively connected to the metal braided wire 161 by sandwiching the metal braided wire 161 therebetween.

Further, JP-A-2009-123584 discloses a waterproof shield connector in which the rear holder 150 described above is omitted and instead a waterproof ring to seal between the terminal insertion hole of the resin housing and the electric wire is modified to an improved structure in which a reinforcing resin member is embedded and equipped.

However, the waterproof shield connector 100 disclosed in JP-A-2005-129355 has a configuration that a dedicated rear holder 150 is mounted to the terminal insertion hole 122 in order to prevent detachment of the waterproof ring 130 and degradation of the waterproof property due to bending of the electric wire 111. As a result, an increase in the number of components and an increase in the number of assembly process are caused due to the mounting of the separate rear holder 150 and correspondingly a manufacturing cost becomes expensive.

Meanwhile, since the rear holder 150 is omitted in the waterproof shield connector disclosed in JP-A-2009-123584, it is possible to reduce the number of components and the number of assembly process. However, it is difficult to prevent a rubber part of the waterproof ring from being distorted in a direction of a bending load when the bending load is applied to the electric wire inserted through the waterproof ring. And, the distortion of the waterproof ring causes the waterproof ring to abut against only one side of the terminal insertion hole and thus there is a possibility that the sealing performance of the waterproof ring is degraded.

SUMMARY OF THE INVENTION

Accordingly, the present invention has been made to solve the above-described problems and an object of the present invention is to provide a waterproof shield connector which is capable of obtaining the cost reduction by reducing the number of components and the number of assembly process and which is capable of preventing the sealing performance of the waterproof ring mounted to the terminal insertion hole of the resin housing from being degraded by the influence of the bending load applied to the electric wire.

The above-described object of the present invention is achieved by the following configurations.

(1) According to an aspect of the invention, a waterproof shield connector includes an electric wire to which a terminal fitting is connected at an end portion of the electric wire, a resin housing that has a terminal insertion hole that holds the end portion of the electric wire and the terminal fitting and a rear opening through which the end portion of the electric wire and the terminal fitting is inserted into the terminal insertion hole, a rubber waterproof ring that is fitted to the terminal insertion hole so that an inner periphery of the waterproof ring is in close contact with an outer peripheral surface of the electric wire in the terminal insertion hole and an outer periphery of the waterproof ring is in close contact with an inner peripheral surface of the terminal insertion hole and seals a gap between the electric wire and the terminal insertion hole, and a shield shell that is fitted to an outer side of the resin housing to cover an outer periphery of the resin housing and electromagnetically shield the resin housing. The shield shell is integrally formed with a ring pressing part that closes the rear end opening to cover a rear end of the waterproof ring disposed in the terminal insertion hole and prevent the waterproof ring from a detachment. The shield shell is integrally formed with a electric wire pressing part that is fitted to an outer periphery of the electric wire inserted into the terminal insertion hole and restricts displacement of the electric wire in a radial direction of the electric wire.

According to the configuration of the above (1), detachment of the waterproof ring fitted and mounted to the terminal insertion hole of the resin housing is prevented by the ring pressing part formed integrally with the shield shell which is fitted and mounted to an outer side of the resin housing.

Accordingly, as compared to a waterproof shield connector 100 in which a separate rear holder is provided in order to prevent detachment of the waterproof ring, a rear holder is omitted and correspondingly the number of components and the number of assembly process are reduced, so that it is possible to obtain the cost reduction.

Further, since a radial displacement of the electric wire end of the electric wire with the terminal inserted through the waterproof ring is restricted by the electric wire pressing part formed integrally with the shield shell, a bending load applied to the electric wire does not affect the waterproof ring and thus it is possible to prevent the waterproof ring from being distorted in a direction of the bending load. Accordingly, there is no need to embed a resin member in the waterproof ring and correspondingly the waterproof ring can be simply manufactured, as compared to the waterproof shield connector 100 in which a reinforcing resin member is embedded in the waterproof ring. Furthermore, the sealing performance of the waterproof ring mounted in the terminal insertion hole of the resin housing is prevented from being degraded by the influence of the bending load applied to the electric wire.

According to the waterproof shield connector of the present invention, detachment of the waterproof ring fitted and mounted to the terminal insertion hole of the resin housing is prevented by the ring pressing part formed integrally with the shield shell which is fitted and mounted to an outer side of the resin housing. Accordingly, as compared to a waterproof shield connector 100 in which a separate rear holder is provided in order to prevent detachment of the waterproof ring, a rear holder is omitted and correspondingly the number of components and the number of assembly process are reduced, so that it is possible to obtain the cost reduction.

Further, since a radial displacement of the electric wire end of the electric wire with the terminal inserted through the waterproof ring is restricted by the electric wire pressing part formed integrally with the shield shell, a bending load applied to the electric wire does not affect the waterproof ring and thus it is possible to prevent the waterproof ring from being distorted in a direction of the bending load. Accordingly, there is no need to embed a resin member in the waterproof ring and correspondingly the waterproof ring can be simply manufactured, as compared to the waterproof shield connector 100 in which a reinforcing resin member is embedded in the waterproof ring. Furthermore, the sealing performance of the waterproof ring mounted in the terminal insertion hole of the resin housing is prevented from being degraded by the influence of the bending load applied to the electric wire.

Hereinabove, the present invention has been briefly described. In addition, details of the present invention will be further clarified by thoroughly reading a mode (hereinafter, referred to as an "illustrative embodiment") for carrying out the invention (which will be described below) with reference to the accompanying drawings.

BRIEF DESCRIPTION OF DRAWINGS

FIG. 4 is a longitudinal sectional view showing a waterproof shield connector in a related art.

DESCRIPTION OF EMBODIMENTS

Hereinafter, a waterproof shield connector according to a preferred embodiment of the present invention will be described in detail with reference to the accompanying drawings.

Figure 1:
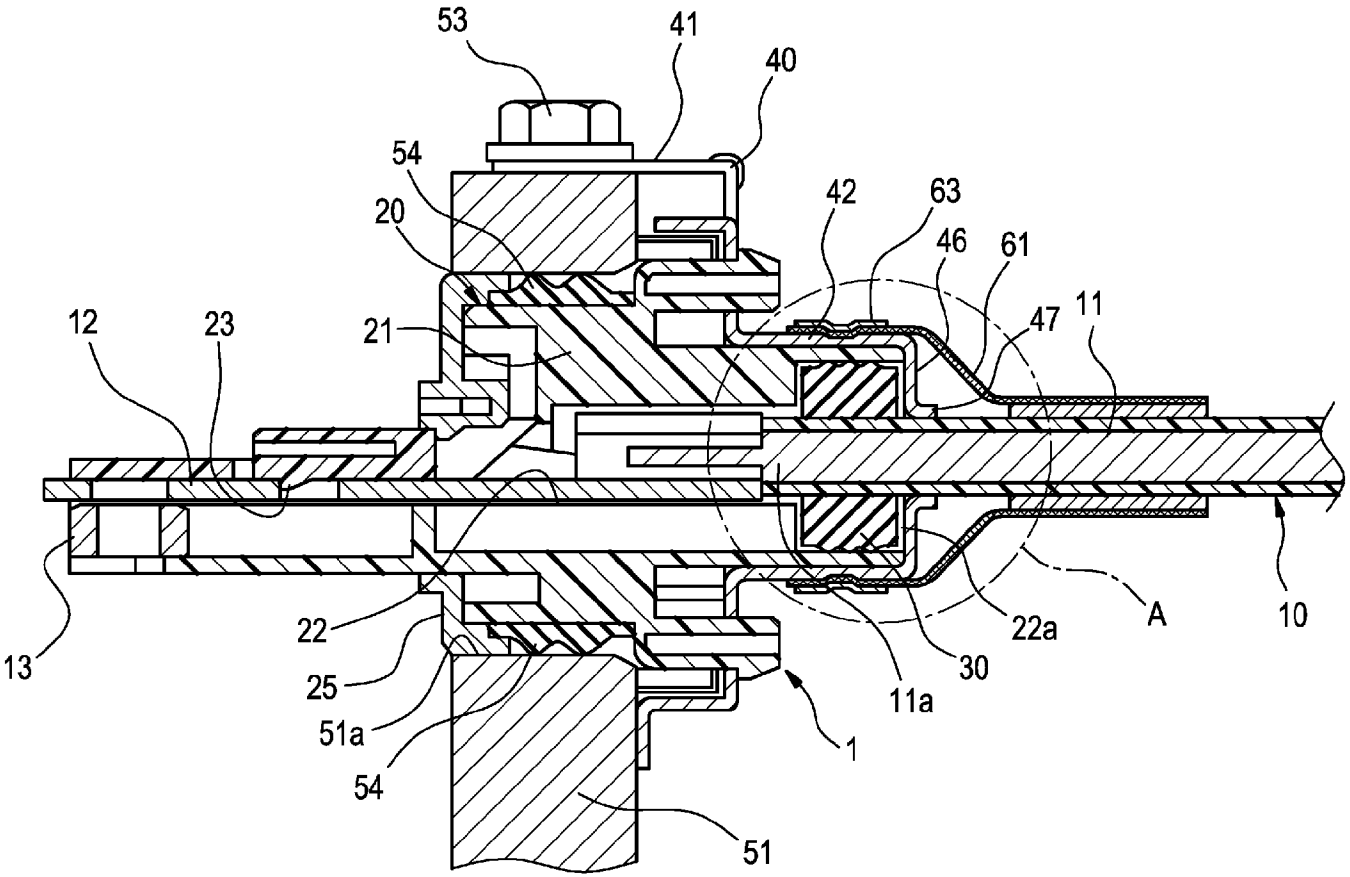
FIG. 1 is a longitudinal sectional view showing a waterproof shield connector according to an illustrative embodiment of the present invention.
Figure 2:
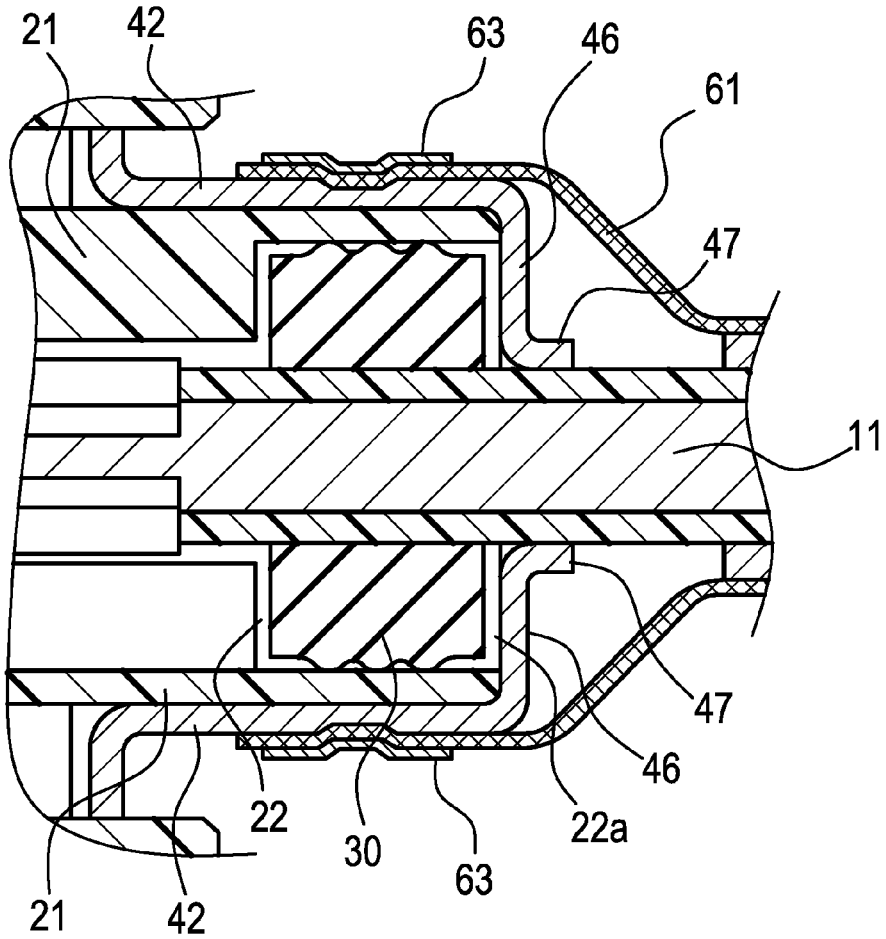
FIG. 2 is an enlarged view of "A" portion shown in FIG. 1.
Figure 3:
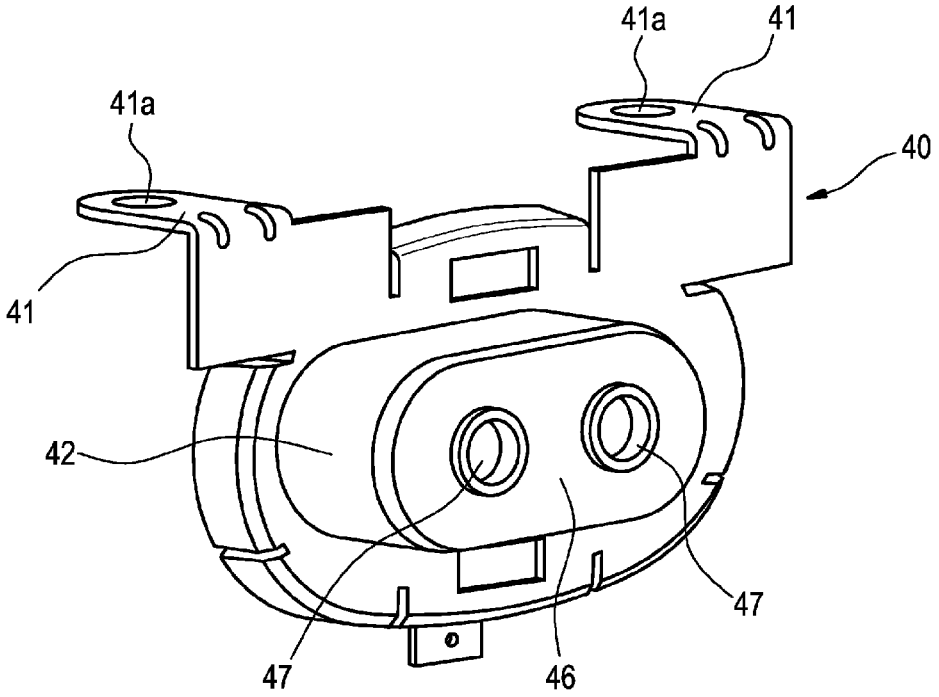
FIG. 3 is an external perspective view of a shield shell shown in FIG. 2.

FIG. 1 to FIG. 3 shows an illustrative embodiment of a waterproof shield connector according to the present invention. FIG. 1 is a longitudinal sectional view showing the waterproof shield connector according to the illustrative embodiment of the present invention, FIG. 2 is an enlarged view of "A" portion shown in FIG. 1 and FIG. 3 is an external perspective view of a shield shell shown in FIG. 2.

A waterproof shield connector 1 of the illustrative embodiment includes an electric wire 10 with a terminal, a resin housing 20, a waterproof ring 30 and a shield shell 40.

In the electric wire 10 with the terminal, an end (electric wire end) 11*a* of a covered electric wire 11 is connected to a terminal fitting 12 which is conductively connected to a connection terminal of an equipment. A nut 13 for screwing the connection terminal of the equipment is fixedly equipped to a leading end of the terminal fitting 12.

As shown in FIG. 1, the resin housing 20 includes a case fitting part 21 which is fitted and connected to a connector fitting hole 51*a* of a metallic shield case (housing) 51 of the equipment and a terminal insertion hole 22 which is formed through the case fitting part 21.

The shield case 51 is a metallic housing for connecting a connector, which is equipped to an inverter device or the like of an electric vehicle or a hybrid-electric vehicle, for example.

The terminal insertion hole 22 of the resin housing 20 is a hole part which receives and holds the electric wire end 11*a* of the electric wire 10 with the terminal and the terminal fitting 12 through a rear end opening 22*a* thereof. The resin housing 20 of the present embodiment is provided with two terminal insertion holes 22 side-by-side so as to receive and hold two electric wires 10 with the terminal.

The terminal fitting 12 received in the terminal insertion hole 22 is locked to a lance 23 equipped to face the terminal insertion hole 22 and therefore is prevented from being detached. A leading end of the terminal fitting 12 locked to the lance 23 protrudes from a leading end of the case fitting part 21 and is connected to a connection terminal (not shown) in the shield case 51.

The waterproof ring 30 is fitted and mounted to the terminal insertion hole 22. The waterproof ring 30 is arranged in the terminal insertion hole 22 in such a way that an inner periphery of the waterproof ring is in close contact with an outer peripheral surface of the covered electric wire 11 in the terminal insertion hole 22 and an outer periphery thereof is in close contact with an inner peripheral surface of the terminal insertion hole 22. In this way, sealing between the covered electric wire 11 and the terminal insertion hole 22 is achieved so that a waterproof property is secured in the terminal insertion hole 22.

As shown in FIG. 1, the case fitting part 21 of the resin housing 20 is fitted to the connector fitting hole 51*a* of the shield case 51 via a rubber seal ring 54. An inner periphery of the seal ring 54 is in close contact with an outer peripheral surface of the case fitting part 21 and an outer periphery thereof is in close contact with an inner peripheral surface of the connector fitting hole 51*a* to seal between the shield case 51 and the case fitting part 21.

A ring holder 25 is attached to a front end of the case fitting part 21 for positioning and fixing the seal ring 54 to an outer periphery of the case fitting part 21.

The shield shell 40 is made of metal and is fitted and mounted to an outer side of the resin housing 20 from the rear end side thereof so as to cover an outer periphery of the resin housing 20, so that an interior of the resin housing 20 is electromagnetically shielded from the surroundings. The shield shell 40 includes a case connection part 41 conductively connected to the shield case 51 and a housing fitting cylinder part 42 having a cylindrical structure and covering an outer periphery of the case fitting part 21 of the resin housing 20.

The case connection part 41 is formed with a bolt insertion hole 41*a*, as shown in FIG. 3 and fixed to the shield case 51 by a bolt 53, as shown in FIG. 1. By fixing the case connection part 41 to the shield case 51 by the bolt 53, the shield shell 40 is ground-connected to the shield case 51.

As shown in FIG. 2, the housing fitting cylinder part 42 of the shield shell 40 is covered with an end of a metal braided wire 61 for electromagnetic shielding, which covers the covered electric wire 11. The metal braided wire 61 covering the housing fitting cylinder part 42 is ground-connected to the housing fitting cylinder part 42 via a ring member 63 tightening an outer periphery of the housing fitting cylinder part 42.

In the present embodiment, the shield shell 40 is integrally formed with a ring pressing part 46 and an electric wire pressing part 47, as shown in FIG. 2 and FIG. 3.

As shown in FIG. 2 and FIG. 3, the ring pressing part 46 is a wall part formed integrally to a rear end of the housing fitting cylinder part 42. The ring pressing part 46 closes the rear end opening 22*a* so as to cover a rear end of the waterproof ring 30 in the terminal insertion hole 22, thereby preventing detachment of the waterproof ring 30.

As shown in FIG. 2 and FIG. 3, the electric wire pressing part 47 has a substantially cylindrical structure and is fitted to an outer periphery of the covered electric wire 11 inserted into the terminal insertion hole 22, thereby restricting displacement of the covered electric wire 11 in a radial direction. The electric wire pressing part 47 is formed integrally with the ring pressing part 46.

In the waterproof shield connector 1 of the illustrative embodiment described above, detachment of the waterproof ring 30 fitted and mounted to the terminal insertion hole 22 of the resin housing 20 is prevented by the ring pressing part 46 formed integrally with the shield shell 40 which is fitted and mounted to an outer side of the resin housing 20, as shown in FIG. 2.

Accordingly, as compared to a waterproof shield connector 100 in which a separate rear holder is provided in order to prevent detachment of the waterproof ring 130, a rear holder may be omitted and correspondingly the number of components and the number of assembly process are reduced, so that it is possible to obtain the cost reduction.

Further, since a radial displacement of the electric wire end 11*a* of the covered electric wire 11 inserted through the waterproof ring 30 is restricted by the electric wire pressing part 47 formed integrally with the shield shell 40, a bending load applied to the covered electric wire 11 does not affect the waterproof ring 30 and thus it is possible to prevent the waterproof ring 30 from being distorted in a direction of the bending load.

Accordingly, there is no need to embed a resin member in the waterproof ring 30 and correspondingly the waterproof ring 30 can be simply manufactured, as compared to the waterproof shield connector 100 in which a reinforcing resin member is embedded in the waterproof ring 30. Furthermore, the sealing performance of the waterproof ring 30 mounted in the terminal insertion hole 22 of the resin housing 20 is prevented from being degraded by the influence of the bending load applied to the covered electric wire 11.

The present invention is not limited to the above-described illustrative embodiments and various modifications and improvements may be made to the illustrative embodiment. In addition, materials, shapes, dimensions, numerical values, forms, numbers and locations of each component in the above-described illustrative embodiment are not limited but may be arbitrarily set, as long as the object of the present invention is achieved.

For example, the waterproof shield connector of the illustrative embodiment is a two-pole connector in which the resin housing receives and holds two electric wires with the terminal. However, the structure of the present invention may be applied to one-pole waterproof shield connector or multi-pole waterproof shield connector in which the resin housing receives and holds three or more electric wires with the terminal.

Further, in the waterproof shield connector according to the present invention, a synthetic rubber with moderate elasticity may be used as the material of the waterproof ring fitted and mounted to the terminal insertion hole of the resin housing.

REFERENCE SIGNS LIST

1: WATERPROOF SHIELD CONNECTOR
10: ELECTRIC WIRE WITH TERMINAL
11: COVERED ELECTRIC WIRE
11*a*: ELECTRIC WIRE END
20: RESIN HOUSING
22: TERMINAL INSERTION HOLE
22*a*: REAR END OPENING
30: WATERPROOF RING
40: SHIELD SHELL
46: RING PRESSING PART
47: ELECTRIC WIRE PRESSING PART

What is claimed is:

1. A waterproof shield connector comprising:

an electric wire to which a terminal fitting is connected at an end portion of the electric wire;

a resin housing that has a terminal insertion hole that holds the end portion of the electric wire and the terminal fitting and a rear opening through which the end portion of the electric wire and the terminal fitting is inserted into the terminal insertion hole;

a rubber waterproof ring that is fitted to the terminal insertion hole so that an inner periphery of the waterproof ring is in contact with an outer peripheral surface of the electric wire in the terminal insertion hole and an outer periphery of the waterproof ring is in contact with an inner peripheral surface of the terminal insertion hole and seals a gap between the electric wire and the terminal insertion hole; and a shield shell that is fitted to an outer side of the resin housing to cover an outer periphery of the resin housing and electromagnetically shield the resin housing, wherein the shield shell is integrally formed with a ring pressing part that closes the rear end opening to cover a rear end of the waterproof ring disposed in the terminal insertion hole and prevent the waterproof ring from a detachment, and the shield shell is integrally formed with an electric wire pressing part that is fitted to an outer periphery of the electric wire inserted into the terminal insertion hole and restricts displacement of the electric wire in a radial direction of the electric wire.

2. The waterproof shield connector of claim 1, wherein the resin housing further comprises a case fitting part which is configured to be connected to a metallic shield case of an equipment.

* * * * *